US010920463B2

(12) United States Patent
Estrada et al.

(10) Patent No.: US 10,920,463 B2
(45) Date of Patent: Feb. 16, 2021

(54) SIDE DOOR OCCUPANT LATCH WITH MANUAL RELEASE AND POWER LOCK

(71) Applicants: Eduardo Estrada, Ciudad Juarez Chihuahua (MX); Hector Sanchez, Ciudad Juarez Chihuahua (MX); Rodrigo Galindo, Ciudad Juarez Chihuahua (MX); Oscar Estrada, Ciudad Juarez Chihuahua (MX); Carlos Tostado, Ciudad Juarez Chihuahua (MX)

(72) Inventors: Eduardo Estrada, Ciudad Juarez Chihuahua (MX); Hector Sanchez, Ciudad Juarez Chihuahua (MX); Rodrigo Galindo, Ciudad Juarez Chihuahua (MX); Oscar Estrada, Ciudad Juarez Chihuahua (MX); Carlos Tostado, Ciudad Juarez Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 633 days.

(21) Appl. No.: 14/959,841

(22) Filed: Dec. 4, 2015

(65) Prior Publication Data

US 2016/0160537 A1 Jun. 9, 2016

Related U.S. Application Data

(60) Provisional application No. 62/087,785, filed on Dec. 4, 2014.

(51) Int. Cl.
*E05B 81/06* (2014.01)
*E05B 77/38* (2014.01)
(Continued)

(52) U.S. Cl.
CPC ..... *E05B 81/06* (2013.01); *E05B 77/38* (2013.01); *E05B 81/14* (2013.01); *E05B 85/26* (2013.01); *E05C 3/12* (2013.01); *E05C 19/12* (2013.01)

(58) Field of Classification Search
CPC ..... E05B 77/38; E05B 77/40; E05B 85/02; E05B 15/1635; E05B 17/0045;
(Continued)

(56) References Cited

U.S. PATENT DOCUMENTS 4,892,339 A 1/1990 Kleefeldt et al.
5,454,608 A 10/1995 Dzurko et al.
(Continued)

FOREIGN PATENT DOCUMENTS

CN 101184900 A 5/2008
CN 101918662 A 12/2010
(Continued)

OTHER PUBLICATIONS

International Seach Report for International Application No. PCT/US2015/064053; International Filing Date: Dec. 4, 2015; dated Apr. 14, 2016; 3 pgs.
(Continued)

*Primary Examiner* — Mark A Williams
(74) *Attorney, Agent, or Firm* — Cantor Colburn LLP

(57) ABSTRACT

A latch having: a claw configured to rotate between an unlatched position and a latched position; a pawl configured for movement between an engaged position and a disengaged position, wherein the pawl retains the claw in the latched position when the pawl is in the engaged position and wherein the pawl releases the claw when it is in a disengaged position and the claw is free to move from the latched position to the unlatched position; a bumper located on the pawl to dampen noises as the pawl is moved by a
(Continued)

portion of the claw; and wherein the detent lever is pivotally mounted to a frame of the latch proximate to a corner of an opening of the latch.

13 Claims, 4 Drawing Sheets

(51) Int. Cl.
*E05B 85/26* (2014.01)
*E05B 81/14* (2014.01)
*E05C 3/12* (2006.01)
*E05C 19/12* (2006.01)

(58) Field of Classification Search
CPC .. E05B 77/36; Y10T 292/688; Y10T 74/2135; Y10S 292/56; Y10S 292/73
See application file for complete search history.

(56) References Cited

U.S. PATENT DOCUMENTS

| | | | | |
|---|---|---|---|---|
| 5,520,426 | A | 5/1996 | Arabia, Jr. et al. | |
| 5,544,925 | A * | 8/1996 | Ikeda | E05B 17/0012 292/216 |
| 6,419,286 | B1 * | 7/2002 | Szablewski | E05B 77/24 292/216 |
| 8,141,916 | B2 | 3/2012 | Tomaszewski et al. | |
| 2003/0222462 | A1 | 12/2003 | Bruce | |
| 2005/0062295 | A1 * | 3/2005 | Ketelsen | E05B 85/26 292/216 |
| 2008/0203737 | A1 | 8/2008 | Tomaszewski et al. | |
| 2011/0041572 | A1 | 2/2011 | Lefebvre et al. | |
| 2011/0133493 | A1 | 6/2011 | Perkins et al. | |
| 2015/0076835 | A1 | 3/2015 | Mitchell et al. | |

FOREIGN PATENT DOCUMENTS

| | | | |
|---|---|---|---|
| CN | 102858566 | A | 1/2013 |
| CN | 104114793 | A | 10/2014 |
| EP | 1195487 | A2 | 4/2002 |
| EP | 1853783 | B1 | 1/2016 |
| KR | 1020070116795 | A | 12/2007 |

OTHER PUBLICATIONS

International Written Opinion for International Application No. PCT/US2015/064053; International filing date: Dec. 4, 2015; dated Apr. 14, 2016; 4 pgs.
CN Office Action dated Jul. 6, 2018 for Applicaiton No. 201510864554.0.
CN Office Action dated Oct. 23, 2017 for Applicaiton No. 201510864554.0.
CN Office Action dated Oct. 8, 2018 for Applicaiton No. 201580065323.1.
English Translation to CN Office Action dated Jul. 6, 2018 for Applicaiton No. 201510864554.0.
English Translation to CN Office Action dated Oct. 23, 2017 for Applicaiton No. 201510864554.0.
English Translation to CN Office Action dated Oct. 8, 2018 for Applicaiton No. 201580065323.1.
Experimental Study on Automobile Parts Grease Lubrication (edited by Xie Xiaopeng, Lan Bingli, Huang Bo, pp. 126-129, Tsinghua University Press, Apr. 2014, first edition).
Search Report for CN Application No. 2015108645540 dated Dec. 15, 2015.

* cited by examiner

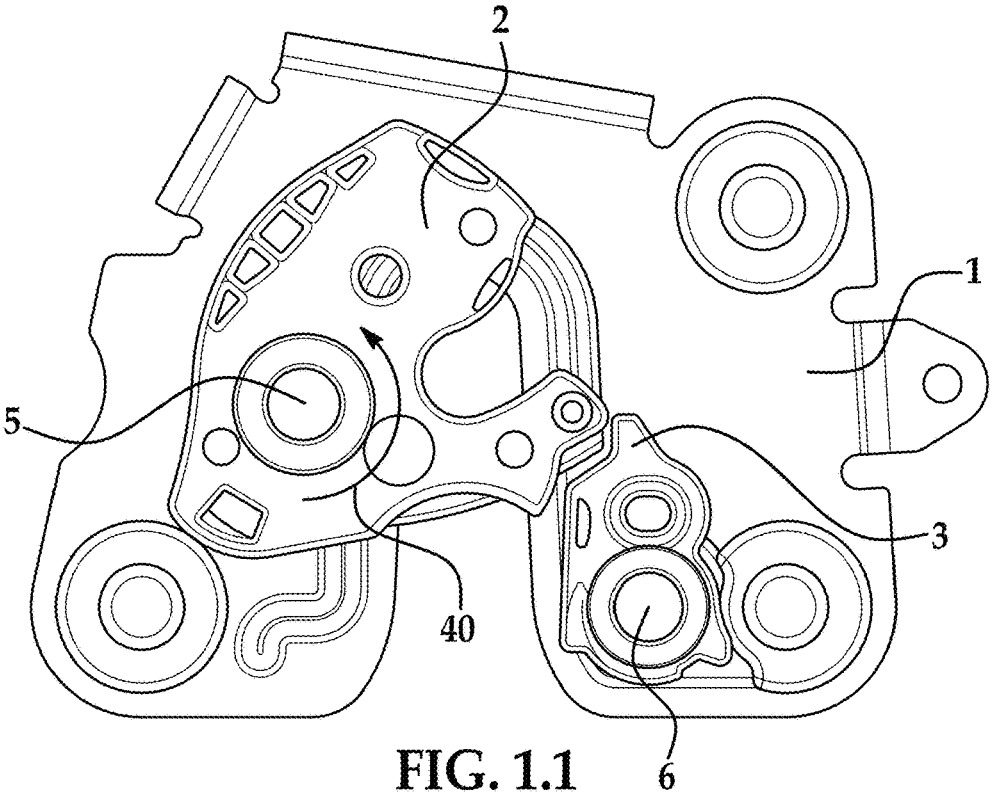
FIG. 1.1
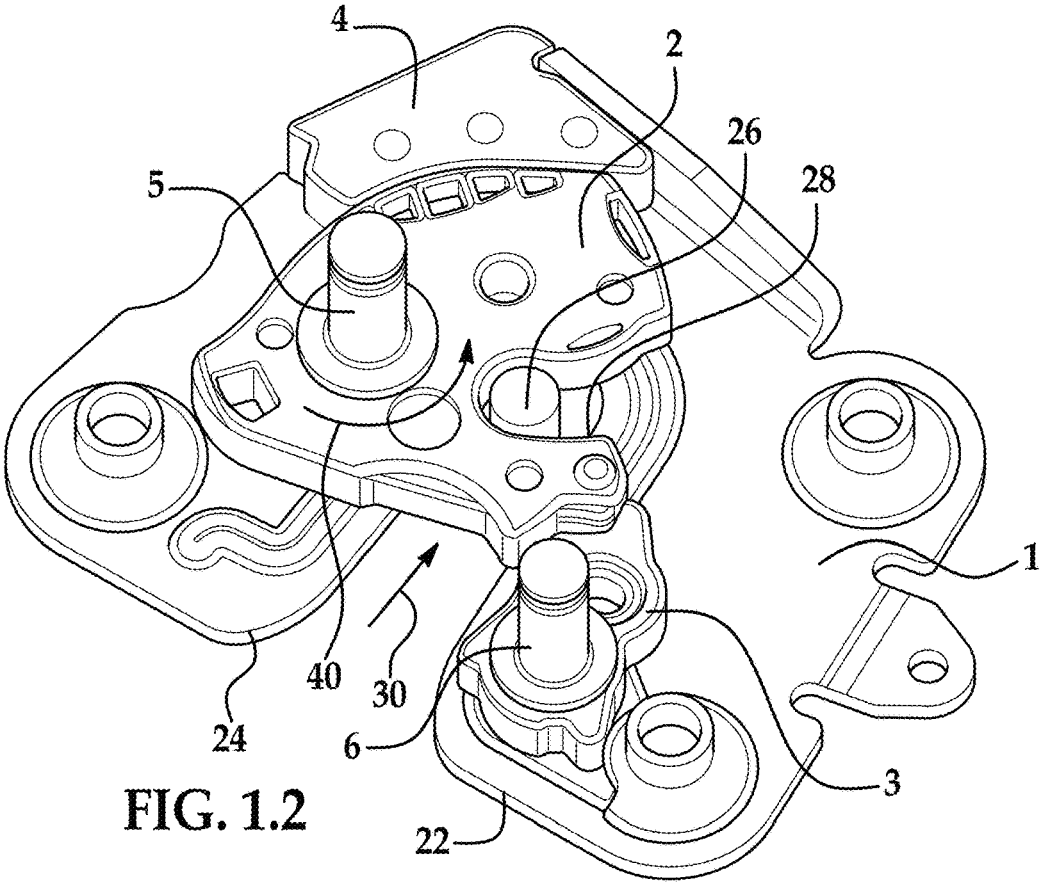
FIG. 1.2

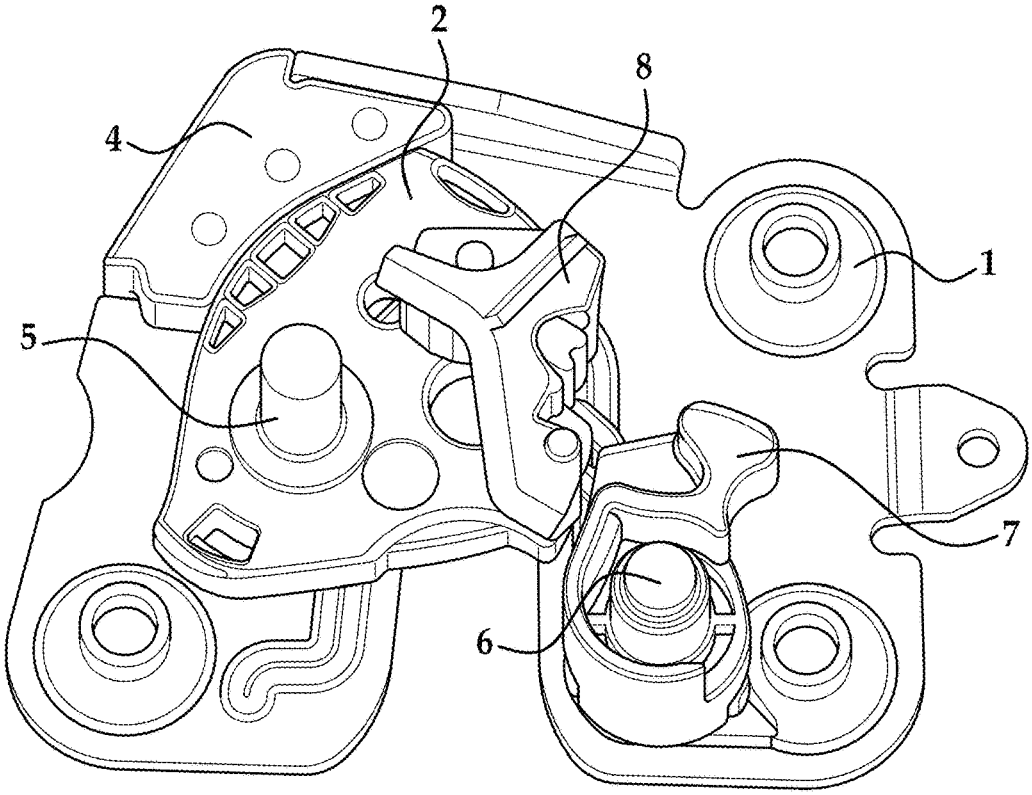
FIG. 1.3
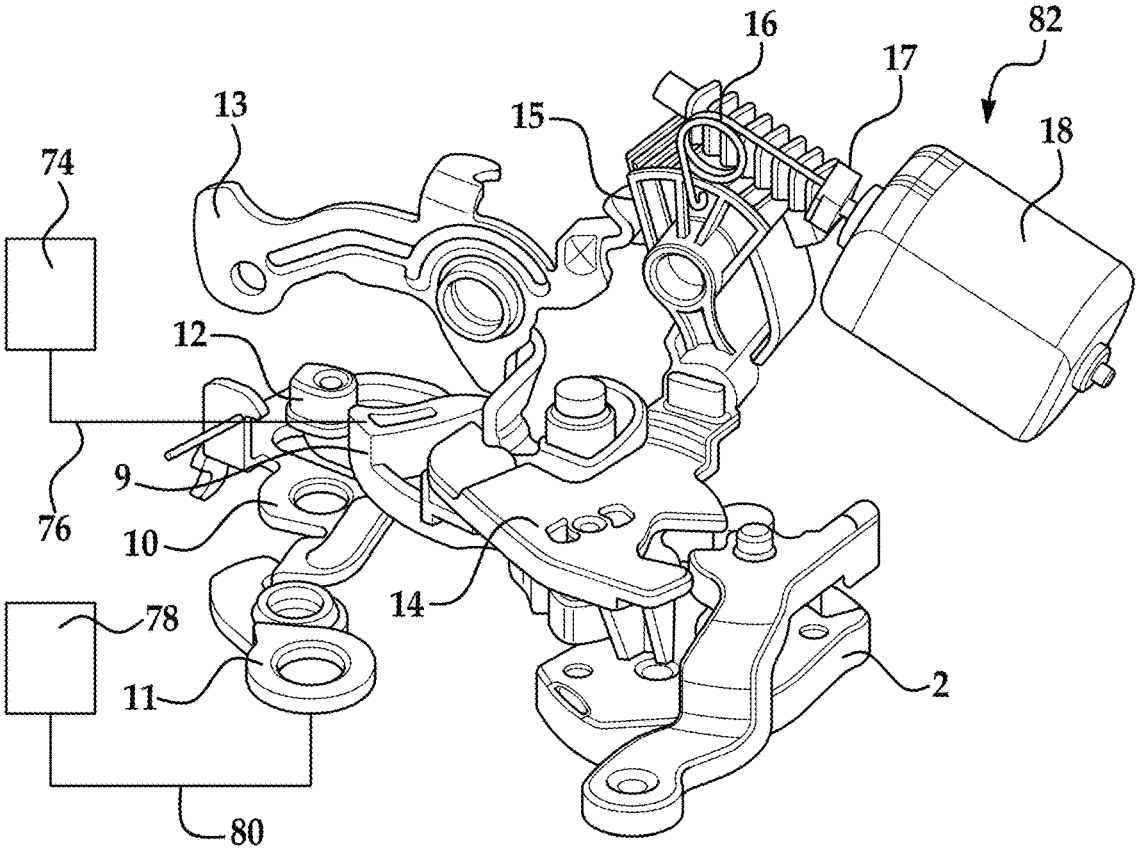
FIG. 1.4

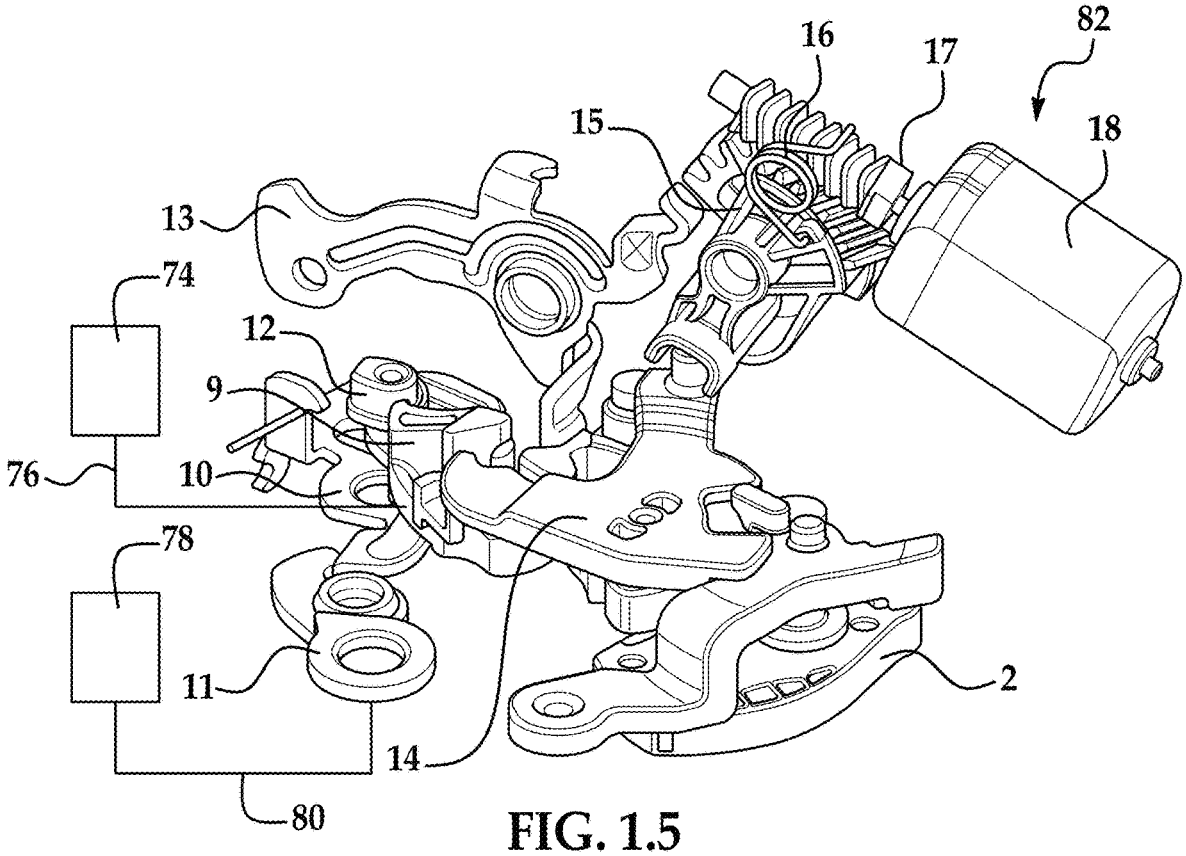
FIG. 1.5
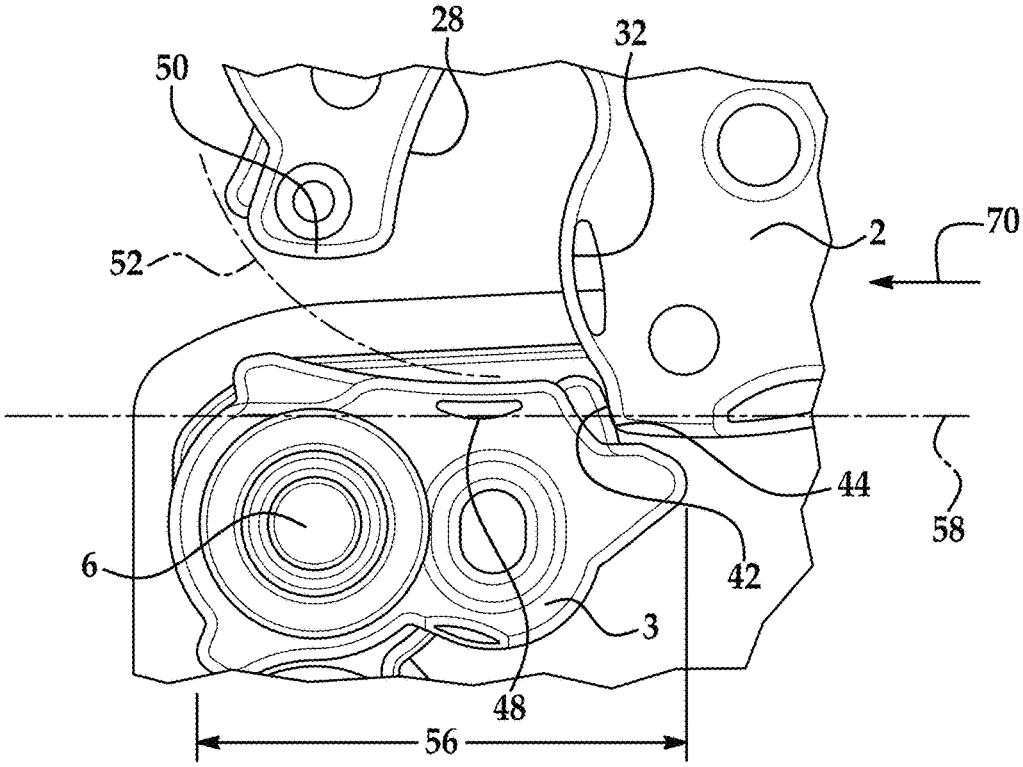
FIG. 2A

SIDE DOOR OCCUPANT LATCH WITH MANUAL RELEASE AND POWER LOCK

This application claims the benefit of U.S. provisional patent Application Ser. No. 62/087,785, filed Dec. 4, 2014, the entire contents of which are incorporated herein by reference thereto.

TECHNICAL FIELD

Embodiments of the present invention relate generally to latches and, more particularly, to latches for vehicles.

BACKGROUND

Latches are used to restrain the movement of one member or element with respect to another. For example, door latches restrain the movement of a door with respect to a surrounding door frame. The function of such latches is to hold the door secure within the frame until the latch is released and the door is free to open. Existing latches typically have mechanical connections linking the latch to actuation elements such as handles which can be actuated by a user to release the latch. Movement of the actuation elements is transferred through the mechanical connections that cause the latch to release. The mechanical connections can be one or more rods, cables, or other suitable elements or devices.

Latch sound quality can enhance or detract from the overall perception of quality by an end user about the construction of the vehicle. For example, good sound quality may imply solid construction, smooth operation, and thoughtfulness of design. As a result, vehicle manufacturers are placing more emphasis on the ability of the door latch to absorb the noise emissions that may occur during a closing event. Sound quality metrics, such as minimal loudness and frequency content for example, are affected by many variables including the profile geometry, small features, and material selection of the components of a latch mechanism.

Accordingly, while existing vehicle latch mechanisms are suitable, the need for improvement remains, particularly in providing a latch mechanism having improved noise dampening and energy absorption.

SUMMARY OF THE INVENTION

In accordance with one embodiment, a latch is provided. The latch having: a claw configured to rotate between an unlatched position and a latched position; a pawl configured for movement between an engaged position and a disengaged position, wherein the pawl retains the claw in the latched position when the pawl is in the engaged position and wherein the pawl releases the claw when it is in a disengaged position and the claw is free to move from the latched position to the unlatched position; a bumper located on the pawl to dampen noises as the pawl is moved by a portion of the claw; and wherein the detent lever is pivotally mounted to a frame of the latch proximate to a corner of an opening of the latch.

In another embodiment, a vehicle door latch having components illustrated in the attached figures is provided.

In yet another embodiment, a vehicle door latch as disclosed herein is provided.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which:

FIG. 1.1 shows a small retention assembly of a latch with a small detent in a primary position;

FIG. 1.2 illustrates claw contact of the latch with a claw bumper;

FIG. 1.3 illustrates contact between the detent release lever and an overslam bumper;

FIG. 1.4 illustrates the latch assembly in an unlock position;

FIG. 1.5 shows the latch assembly in a lock position; and

FIGS. 2A-2C illustrate movement of the claw of a latch assembly in accordance with one embodiment of the present invention.

DETAILED DESCRIPTION

Current designs for a side door latch are exceeding the requirements of mass, package, sound, fast lock unlock and costs. Various embodiments of the present invention are directed to latch assemblies wherein the package size is reduced without affecting performance in addition to reducing the mass, sound and price of the latch assembly.

Various embodiments of the disclosed latch achieve are noise reduction during operation and in a steady state, fast lock and unlock performance, low energy release efforts required to open the latch, prevention of water intrusion and lower cost as well as smaller overall package size.

In one embodiment, the disclosed side door latch will have a small detent that allows the entire package size to be reduced while keeping the same performance of strength of a larger sized latch. As such, the mass and the price of the disclosed latch is reduced.

Through the use of a direct central door locking mechanism the timing for the lock and unlock of the latch is reduced.

FIG. 1.1 shows the small retention assembly of a latch in accordance with an embodiment of the invention with a small detent in primary position.

FIG. 1.2 shows a claw in contact with a claw bumper in order to improve the sound quality during operation of the latch.

FIG. 1.4 shows the latch assembly in an unlock position and FIG. 1.5 shows the latch assembly in a lock position.

Figure 2B:
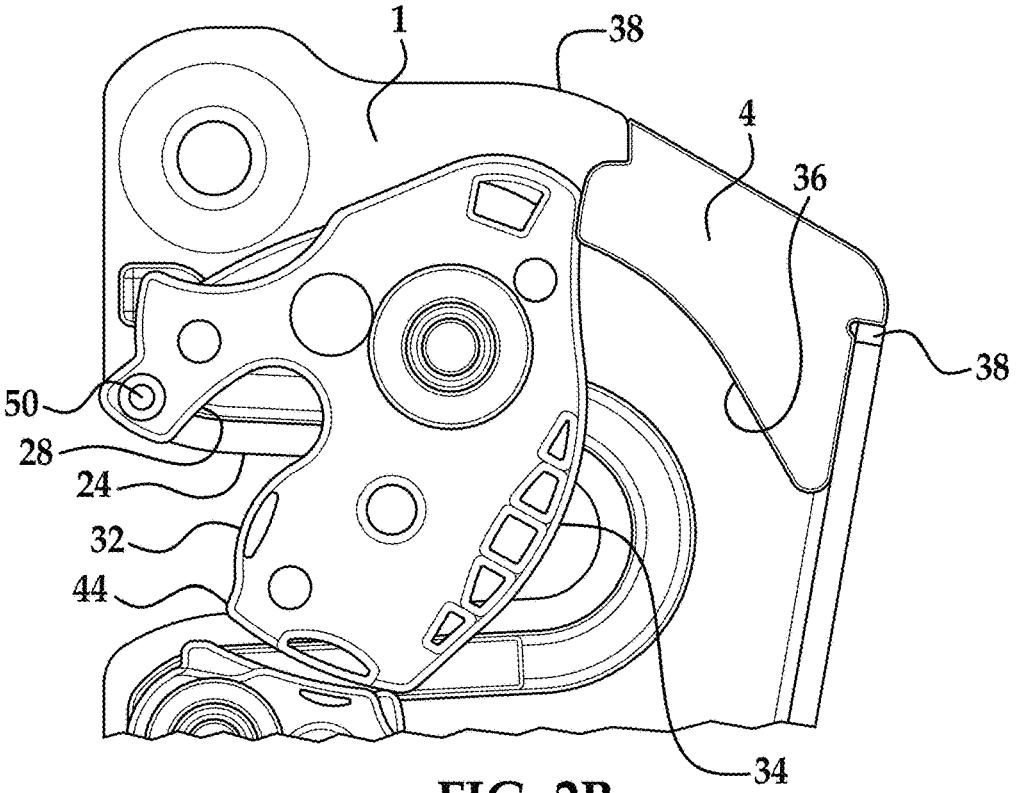
Figure 2C:
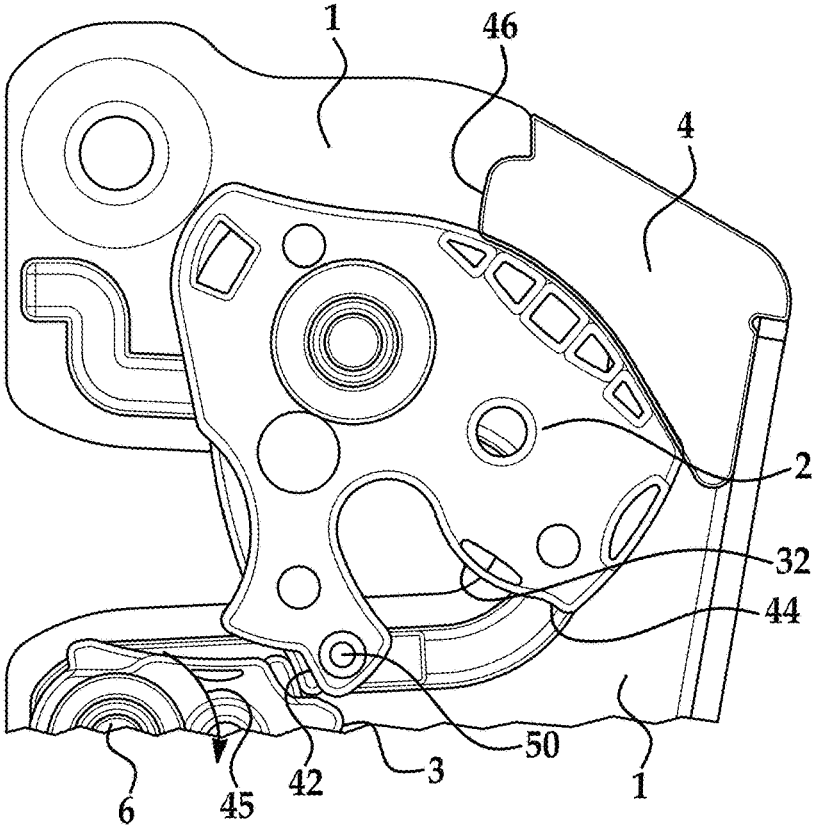

FIGS. 2A-2C illustrate movement of the claw of a latch assembly in accordance with one embodiment of the present invention.

With reference to all of the FIGS., an exemplary latch having improved sound performance is illustrated. The latch is movable between a latched position and an unlatched position, and is configured to have a housing. The latch may be integrated into a component of a vehicle, such as the vehicle structure adjacent a lift gate, trunk, door, or any other operable component for example.

The latch includes a fork bolt or claw and a cooperating detent lever or pawl for maintaining the fork bolt or claw in the latched position. The fork bolt or claw and the detent lever or pawl are each pivotally mounted to the housing or frame of the latch by a stud or pivot. The fork bolt may be biased into an open position and the detent lever may be biased into engagement with the fork bolt by for example a biasing mechanism. In one embodiment, the biasing mechanism may be coil or torsion spring. The fork bolt has a slot or throat for receiving and retaining a striker that may be located on a complementary vehicle component, such as a vehicle frame. The latch may also be used in applications where the compressed weather stripping or seals are used to bias the claw into the open position as they will push open the door that latch is secured to when the latch is unlocked and the corresponding movement of the door will in turn cause the striker to rotate the claw into or towards an open position.

In the attached FIGS. a latch 20 according to various embodiments of the present invention is illustrated. In one embodiment, the latch 20 may be a latch for a side door of a vehicle. Latch 20 has a frame 1 upon which a fork bolt or claw 2 is pivotally mounted. The claw 2 is pivotally mounted about a pivot or pivot pin 5, which may be secured to frame 1. A detent or pawl 3 is also pivotally mounted to the frame and is configured for engagement with the claw 2 as is pivots between an open position, a first or safety position and a closed or latched position during this movement of the claw 2, the detent or pawl 3 moves between an engaged position and a disengaged position and an intermediary position between the engaged position and the disengaged position. The movement of the detent or pawl 3 allows for the movement of the claw 2. The detent of pawl 3 is pivotally mounted about a pivot or pivot pin 6, which may be secured to frame 1.

In accordance with various embodiments of the present invention, the size of the detent lever or pawl 3 is reduced such that the overall size of the latch 20 can be reduced without adversely affecting the performance of the latch 20. In one embodiment, the pivot 6 is located proximate to a corner portion 22 of the frame 1 such that the overall length and size of the claw 2 can be reduced. In one embodiment the corner portion 22 of the frame 1 is located proximate to an opening or slot 24 configured to receive a striker 26 as it is received in the throat 28 of the claw 2 by passing into slot 24 in the direction of arrow 30.

In order to provide noise abatement when the latch 20 is operated, a bumper or buffer 4 is provided. The bumper or buffer may comprise an elastomeric material configured to absorb forces applied to the latch during opening and closing of the latch 20. In addition, a portion of the throat 28 of the claw 2 may have a bumper 32 configured to deflect inwardly upon contact with the striker 26 as it moves into the throat 28 and the slot 24 in the direction of arrow 30. The claw 2 further comprises a curved surface 34 configured to contact a curved surface 36 of the bumper 4 when the claw is in the closed position. See at least FIG. 2C. The bumper 4 extends from a corner portion 38 of the frame 1 towards the claw 2 to define a thickness of the bumper or buffer 4 that will reduce the over travel of the claw 2 as it rotates in the direction of arrow 40 during a closing event as the claw 2 rotates from the open position to a closed position.

When the claw 1 in the closed position a contact surface 42 of the pawl 3 is engaged with or contacts a contact surface 44 of the claw 2. See at least FIG. 2A.

In addition, the bumper or buffer 4 is configured to have a contact end or portion 46 that contacts a portion or contact portion 48 of the claw 2 as it rotates in a direction opposite to that of arrow 40 to the open position. This interaction reduces the claw 2 opening sounds of the latch 20.

Referring now to FIGS. 2A-2B and as the claw 1 rotates in the direction of arrow 40 from the open position of at least FIG. 2B to the 1st safety position of at least FIG. 2A, the contact surface 44 of the claw 2 will contact the pawl 3 and rotate it about pivot 6 in the direction of arrow 45 so that contact surface 44 is in contact with contact end or portion 42 of the pawl 3. The pawl 3 may have a pawl contact portion or spring 48 that is deflected as the claw 2 rotates in the direction of arrow 40. This claw contact portion 48 will also dampen any associated latch noises attributed to the closing of the latch 20 and the rotational movement of the claw 2 in the direction of arrow 40.

As the claw 2 rotates in the direction of arrow 40 from the 1st safety position of FIG. 2A to the closed position of at least FIGS. 1.1, 1.2, 1.3 and 2C a portion 50 of the claw 2 will move in the direction of dashed line 52 and further rotate the pawl 3 in the direction of arrow 45 until portion 50 is in contact with portion 42 of the pawl 3. It being understood that pawl 3 may be spring biased in a direction opposite to that of arrow 45 in order to retain the claw 2 in the latched or closed positions and the 1st safety position.

By locating the pawl 3 at the corner 22 an overall dimension or length 56 of the pawl 3 can be reduced as it is proximate to portions 44 and 54 of the claw when it is in the closed or latched position (FIGS. 1.1, 1.2, 2A and 2C). Moreover, the orientation of the pawl 3 is generally parallel to a line 58, when the claw 2 is in the closed or latched positions as well as the 1st or safety position such that loads in the direction of arrow 70, which may be attributable to a rotational force applied to claw 2 in a direction opposite to arrow 40 are transferred to pin 6 which also allows the overall dimension of the pawl or detent 3 to be reduced in size. This small detent or pawl 3 allows the overall package of the latch 20 to be reduced in size which having the same performance tolerances of a larger profile latch 20. In addition, this also reduces the overall mass of the latch, which is also desirable and in turn also reduces the overall costs to manufacture the latch 20, which is also desirable.

FIG. 1.3 also illustrates a buffer or bumper 8 position to dampen or deaden audible noises associated with an over slam condition where the striker 26 may contact the throat 28 of the claw 2 and/or cause the claw 2 to over travel past the closed position in the direction of arrow 40. The buffer or bumper 8 may be configured to contact a detent release lever during an over slam condition in order to abate audible noises during this event. As with the other buffer or bumpers the bumper 8 may be formed from an elastomeric material.

FIGS. 1.3, 1.4 and 1.5 illustrate other non-limiting components of the latch 20 that are associated with the operation of the latch 20 in order to transition it between its various operational states. These non-limiting components are a pawl release lever 7, a release link 9, and an outside release lever or lever 10 that may be operationally coupled to an outside handle 74 via a rod or cable or any other equivalent device 76. It being understood that handle 74 and rod or cable or device 76 are illustrated schematically via a box and associated line. Also shown is an inside release lever or lever 11 that may be operationally coupled to an inside handle 78 via a rod or cable or any other equivalent device 80. It being understood that handle 78 and rod or cable or device 80 are illustrated schematically via a box and associated line. Also illustrated is a lock lever spring 12 and a release lever 13.

An actuating device 82 may be provided and is illustrated in at least FIGS. 1.4 and 1.5. The actuating device 82 may be configured to unlock and lock the latch 20 by moving the necessary components. The actuating device 82 may configured to open the latch 20 via moving the necessary components, which may include the aforementioned movements associated with locking and unlocking the latch 20. For example and in one embodiment the actuating device 82 is configured to move the detent or pawl 3 away from contact with the fork bolt or claw 2 in order to allow for the latch 20 to transition from a closed position to an open position wherein the retained striker 26 is released from the throat 28 of the fork bolt or claw 2.

The actuator or actuator system 82 may comprise a lock lever 14, a gear 15, a spring 16, which may be an over center spring 16, a worm 17 and a motor 18, wherein the motor 18 is configured to rotate worm 17 which in turn rotates gear 15, which in turn moves lock lever 14, which in turn moves the detent or pawl 3 so that the claw or fork bolt 2 can be released.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch comprising:

a frame having a slot extending inwardly from a peripheral edge of the frame, the frame having a corner located adjacent to the slot at the peripheral edge;

a claw pivotally mounted to the frame and configured to rotate between an unlatched position and a latched position;

a pawl pivotally mounted to the frame at the corner and configured for movement between an engaged position and a disengaged position, the pawl retains the claw in the latched position when the pawl is in the engaged position and the pawl releases the claw when it is in a disengaged position, wherein the claw is free to move from the latched position to the unlatched position when the pawl is in the disengaged position; and a bumper located on the pawl to dampen noises as the pawl is moved by a portion of the claw, wherein a main body portion of the pawl is orthogonally positioned with respect to the peripheral edge of the frame located adjacent to the corner when the pawl is in the engaged position and the main body portion of the pawl is also generally parallel to a load path applied to the pawl by the claw when the pawl is in the engaged position and the claw is in the latched position, wherein pawl extends from a pivot to a distal end, the pivot pivotally mounts the pawl to the frame and the distal end has a contact portion configured to contact and engage contact portions of the claw, wherein the contact portions of the claw are located on opposite sides of a throat of the claw and wherein the pawl extends a first distance from the pivot to the distal end, the first distance being greater than a second distance from the pivot to the corner.

2. The latch as in claim 1, further comprising another bumper located proximate to another corner of the frame, wherein the bumper has a curved portion configured to mate with a complimentary curved surface of the claw when the claw is in the latched position.

3. The latch as in claim 2, wherein the another bumper further comprises a stop portion configured to contact a contact portion of the claw when the claw is in the unlatched position.

4. The latch as in claim 3, wherein the another corner and the corner are orientated on opposite sides of the claw.

5. The latch as in claim 1, further comprising an actuating device configured to unlock and lock the latch.

6. The latch as in claim 5, wherein the actuating device further comprises a motor configured to rotate a gear, wherein rotation of the gear causes movement of the pawl.

7. The latch as in claim 1, further comprising another bumper located proximate to another corner of the frame, wherein the bumper has a curved portion configured to mate with a complimentary curved surface of the claw when the claw is in the latched position.

8. The latch as in claim 7, wherein the another bumper further comprises a stop portion configured to contact a contact portion of the claw when the claw is in the unlatched position.

9. The latch as in claim 8, wherein the another corner and the corner are orientated on opposite sides of the claw.

10. A latch, comprising:

a claw pivotally mounted to a frame of the latch and configured to move between an open position and a closed position;

a pawl pivotally mounted to the frame of the latch and configured to retain the claw in the closed position; and wherein the pawl is pivotally mounted to the frame of the latch proximate to a corner of an opening of the latch, the corner being located at a peripheral edge of the frame and the opening extends inwardly away from the peripheral edge of the frame, wherein the pawl extends from a pivot to a distal end, the pivot pivotally mounts the pawl to the frame and the distal end has a contact portion configured to contact and engage contact portions of the claw, wherein the contact portions of the claw are located on opposite sides of a throat of the claw, the throat of the claw being configured to receive a striker therein and wherein the pawl extends a first distance from the pivot to the distal end, the first distance being greater than a second distance from the pivot to the corner and wherein a main body portion of the pawl is generally parallel to a load path applied to the pawl by the claw when the pawl is in an engaged position and the claw is in the closed position.

11. The latch as in claim 10, further comprising a bumper located proximate to another corner of the frame, wherein the another corner is located at a peripheral edge of the frame and the bumper has a curved portion configured to mate with a complimentary curved surface of the claw when the claw is in the closed position.

12. The latch as in claim 11, wherein the bumper further comprises a stop portion configured to contact a contact portion of the claw when the claw is in the open position.

13. A method of retaining a claw of a latch, comprising:

pivotally mounting a claw to a frame of the latch, wherein the claw is configured to move between an open position and a closed position;

pivotally mounting a pawl to the frame of the latch, wherein the pawl is configured to retain the claw in the closed position; and wherein the pawl is pivotally mounted to the frame of the latch proximate to a corner of an opening of the latch, the corner being located at a peripheral edge of the frame and the opening extends inwardly away from the peripheral edge of the frame, wherein a main body portion of the pawl is orthogonally positioned with respect to the peripheral edge of the frame located adjacent to the corner when the pawl is in an engaged position for retaining the claw in the closed position and the main body portion of the pawl is also generally parallel to a load path applied to the pawl by the claw when the pawl is in the engaged position and the claw is in the closed position, wherein the pawl extends from a pivot to a distal end, the pivot pivotally mounts the pawl to the frame and the distal end has a contact portion configured to contact and engage contact portions of the claw, wherein the contact portions of the claw are located on opposite sides of a throat of the claw and wherein the pawl extends a first distance from the pivot to the distal end, the first distance being greater than a second distance from the pivot to the corner.

* * * * *